US010538885B2

(12) United States Patent
Golbs et al.

(10) Patent No.: US 10,538,885 B2
(45) Date of Patent: Jan. 21, 2020

(54) SOIL COMPACTOR

(71) Applicant: Hamm AG, Tirschenreuth (DE)

(72) Inventors: Markus Golbs, Adorf (DE); Georg Troeger, Schirnding (DE)

(73) Assignee: Hamm AG, Tirschenreuth (DE)

( * ) Notice: Subject to any disclaimer, the term of this patent is extended or adjusted under 35 U.S.C. 154(b) by 36 days.

(21) Appl. No.: 15/879,782

(22) Filed: Jan. 25, 2018

(65) Prior Publication Data

US 2018/0216300 A1 Aug. 2, 2018

(30) Foreign Application Priority Data

Jan. 30, 2017 (DE) ..... 10 2017 101 685

(51) Int. Cl.
*E01C 19/28* (2006.01)

(52) U.S. Cl.
CPC ..... *E01C 19/286* (2013.01)

(58) Field of Classification Search
CPC ..... E01C 19/236; E01C 19/26; E01C 19/282; E01C 19/48; E01C 19/286; E02D 3/026
See application file for complete search history.

(56) References Cited

U.S. PATENT DOCUMENTS 2,701,616 A * 2/1955 Cooper ..... A01B 29/02 16/29
3,026,781 A * 3/1962 Schafer ..... E01C 19/282 404/117
3,052,166 A 9/1962 Thrun
3,909,148 A * 9/1975 Vural ..... E02D 3/046 404/133.05
3,923,412 A * 12/1975 Linz ..... E02D 3/068 404/133.05
5,104,257 A * 4/1992 Lebrero Martinez ..... B62D 33/0604 180/20
5,716,162 A 2/1998 Hodgson

FOREIGN PATENT DOCUMENTS

| | | |
|---|---|---|
| DE | 884373 | 7/1953 |
| EP | 0016872 | 10/1980 |
| JP | 47-34171 | 10/1972 |

OTHER PUBLICATIONS

German Search Report filed in DE 10 2017 101 685.6 dated Dec. 13, 2017.

* cited by examiner

*Primary Examiner* — Abigail A Risic
(74) *Attorney, Agent, or Firm* — Rankin, Hill & Clark LLP

(57) ABSTRACT

A soil compactor includes at least one compactor roller supported on a machine chassis to be rotatable about a roller axis of rotation. The at least one compactor roller is supported in its two axial end areas respectively via a suspension assembly on the machine chassis to be movable with respect to the same. The suspension assembly includes at least one helical spring which couples the compactor roller movably to the machine chassis.

13 Claims, 4 Drawing Sheets

SOIL COMPACTOR

Figure 1:
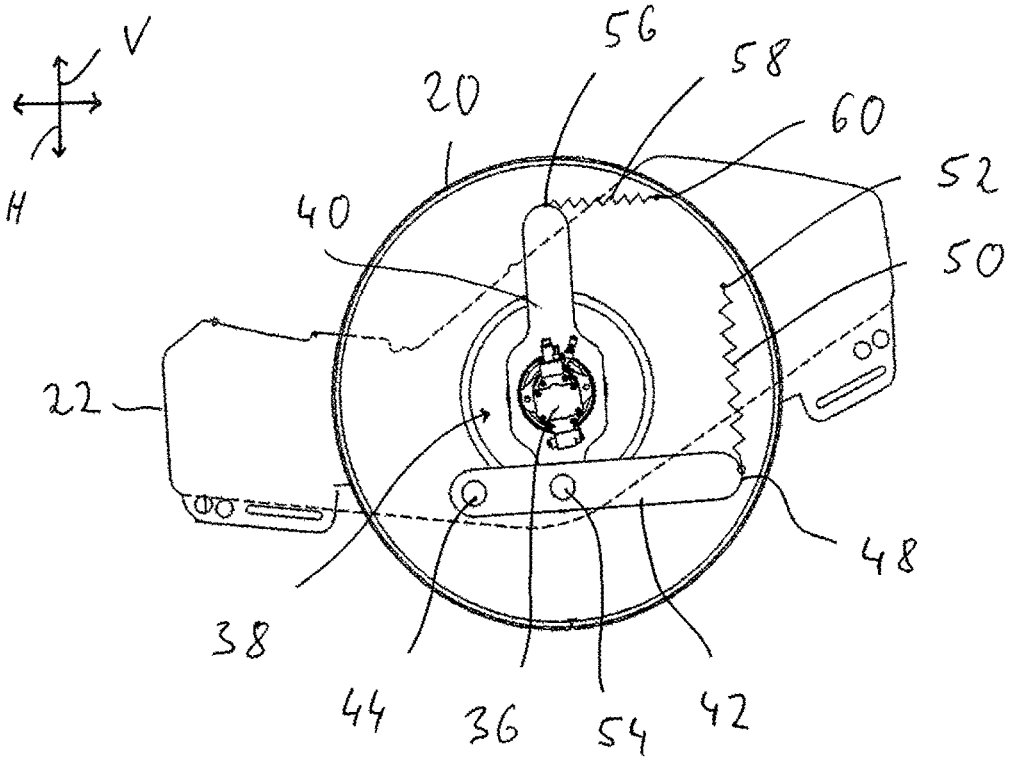

The present invention relates to a soil compactor, comprising at least one compactor roller supported on a machine chassis to be rotatable about a roller axis of rotation, wherein at least one compactor roller is supported in its two axial end areas respectively via a suspension assembly on a machine chassis to be movable with respect to the same.

To improve the compaction efficiency in soil compactors, devices are used in assignment to at least one compactor roller; these same devices generate a force which acts periodically on a compactor roller during compacting operation in which the compactor roller rolls on a substrate to be compacted. The force may be exerted essentially in a vertical direction so that a vibrational acceleration or a vibrational movement of the compactor roller is generated, or may be exerted in the circumferential direction, so that an oscillating acceleration or an oscillating movement of the compactor roller is generated.

In order to ensure, in particular in soil compactors equipped with these types of compactor rollers, that the force periodically acting on a compactor roller is not transferred to the machine chassis on which the compactor rollers are rotatably supported, the compactor rollers are supported on their two axial end areas via suspension means on the machine chassis that permit a relative movement with respect to the machine chassis. For example, it is known from EP 0 168 72 A2 to use pneumatic suspension means. It is known from U.S. Pat. No. 5,716,162 to use suspension means comprising elastically deformable suspension elements constructed from elastomeric material.

It is the object of the present invention to provide a soil compactor in which at least one compactor roller is supported on a machine chassis to be movable with respect to the same in a way that essentially does not negatively affect the compaction efficiency.

This problem is solved according to the invention by a soil compactor, comprising at least one compactor roller supported on a machine chassis to be rotatable about a roller axis of rotation, wherein at least one compactor roller is supported in its two axial end areas respectively via a suspension assembly on the machine chassis to be movable with respect to the same, wherein at least one, preferably each suspension assembly comprises at least one helical spring which couples the compactor roller movably to the machine chassis.

Reference is made to the fact that, in the meaning of the present invention, the movement of the compactor roller with respect to the machine chassis permitted by the suspension assembly is a movement essentially transverse to the roller axis of rotation, if necessary also in the direction of the roller axis of rotation, thus a relative movement between the compactor roller and the machine chassis is permitted in addition to the fundamentally present rotatability of the compactor roller about the roller axis of rotation.

Helical springs, or at least one helical spring is/are used in the construction according to the invention to enable a relative movement between the compactor roller and the machine chassis. It was known that, by using helical springs, a suspension essentially inhibiting the transmission of periodically acting forces from the compactor roller to the machine chassis is achieved, wherein the elements used to provide this suspension, thus the helical springs, essentially do not absorb any energy so that the force periodically exerted to improve the compacting efficiency of a compactor roller, or the energy used therefor, is essentially completely available in the area of the compactor roller for acceleration or for generating a periodic movement of the same. Furthermore, the use of helical springs for the suspension of a compactor roller enables a relative movement with respect to the machine chassis in a larger amount than is possible, for example, when using elastomeric elements, like rubber buffers, which have the tendency to transfer simultaneously damping forces proportional to the speed to the machine chassis.

Reference is made to the fact that, in the meaning of the present invention, springs having one or more spring coils that may be preferably loaded for tension and compression in the direction of a spring longitudinal axis, in particular springs, which have spring coils with a non-zero pitch surrounding a spring longitudinal axis, are considered to be helical springs. These types of helical springs may thereby have a constant radial dimension in the direction of the spring longitudinal axis, thus a coil radius essentially constant with respect to the spring longitudinal axis or an essentially constant radius of curvature of the spring coils. These types of helical springs may also be designed with a pitch varying at least in sections in the direction of the spring longitudinal axis, and/or may have a spring radius varying at least in sections with respect to the spring longitudinal axis and thus a varying radius of curvature of the spring coils, for example to provide a helical spring of this type with an essentially conical form in which the spring coils expand radially outward in a spiral.

In order to enable the suspension of the compactor roller via at least one helical spring in an easy way, while enabling the rotational movement of the compactor roller about the roller axis of rotation, it is proposed that the at least one suspension assembly comprises a roller carrier assembly, wherein the compactor roller is supported on the roller carrier assembly to be rotatable about the roller axis of rotation, and that the roller carrier assembly is coupled to the machine chassis via at least one helical spring.

According to a first embodiment, it may thereby be provided that the roller carrier assembly comprises a first carrier element, which supports the compactor roller to be rotatable about the roller axis of rotation, and a second carrier element, which is pivotably supported in a first coupling area on the machine chassis and is coupled to the machine chassis in a second coupling area via at least one helical spring, wherein the first carrier element is pivotably coupled to the second carrier element in a third coupling area.

To prevent overloading of a helical spring providing the coupling due the lever effect delivered by means of the carrier elements, or the occurrence of unfavorable tilting torques, it is proposed that the third coupling area is positioned between the first coupling area and the second coupling area in a longitudinal extension direction of the second carrier element, and/or that the third coupling area is positioned in the vertical direction approximately below the roller axis of rotation.

Furthermore, an efficient support effect may be guaranteed by a helical spring in that the at least one helical spring, which couples the second carrier element to the machine chassis, is supported, using the machine chassis, in a support area on the machine chassis that is situated in a vertical direction approximately above or below the second coupling area.

In order to be able to provide an efficient support effect while permitting a relative movement of the compactor roller with respect to the machine chassis, particularly in the movement direction of a soil compactor as well, it is proposed that the first carrier element is coupled in a fourth coupling area to the machine chassis via at least one helical spring.

The occurrence of tilting torques may be thereby prevented in that the fourth coupling area is positioned in the vertical direction approximately above or below the third coupling area and/or the roller axis of rotation.

The at least one helical spring, which couples the first carrier element to the machine chassis, may be supported on the machine chassis in a support area situated in the vertical direction approximately at the same height as the fourth coupling area.

In an alternative embodiment of a suspension assembly configured according to the invention, it is proposed that the roller carrier assembly comprises a carrier element supporting the compactor roller to be rotatable about the roller axis of rotation, and that the carrier element is coupled to the machine chassis in a plurality of first coupling areas arranged at a circumferential spacing from one another about the roller axis of rotation via at least one helical spring respectively.

To be able to achieve a stable support interaction in multiple directions between the carrier element and the machine chassis, it is proposed that at least one first coupling area, preferably a plurality of first coupling areas following one another in the circumferential direction about the roller axis of rotation, is provided on the carrier element, and that the carrier element is coupled to the machine chassis via at least two first helical springs in at least one, preferably in each first coupling area. In particular, it may thereby be provided that at least one pair of first coupling areas, situated diametrically opposite one another with respect to the roller axis of rotation, is provided on the carrier element.

For a uniform force transmission between the carrier element and the machine chassis, in at least one pair of first coupling areas, two first helical springs at each of the two first coupling areas may extend, starting from a respective first coupling area, approximately parallel to one another and in opposite directions, and/or, in at least one pair of first coupling areas, two first helical springs at each of the two first coupling areas may extend, starting from a respective first coupling area, angled with respect one another and in opposite directions.

An embodiment is thereby particularly advantageous in which, one pair of first coupling areas on a carrier element is provided with first helical springs extending approximately parallel to one another and one pair of first coupling areas is provided with helical springs angled with respect to one another, wherein preferably the first coupling areas of the one pair of first coupling areas and the first coupling areas of the other pair of first coupling areas are arranged alternating in the circumferential direction, and/or wherein preferably the first coupling areas with first helical springs angled with respect to one another are arranged approximately over one another and the first coupling areas with helical springs extending approximately parallel to one another are situated at approximately the same height in the vertical direction.

To guarantee that the first helical springs have essentially no effective forces to transfer in the direction of the roller axis of rotation, it is proposed that at least one part, particularly all, of the first helical spring are arranged with spring longitudinal axes situated in at least one plane situated essentially orthogonal to the roller axis of rotation.

To guarantee an axial centering of the compactor roller in this embodiment, it may be provided that the carrier element is coupled in at least one second coupling area to the machine chassis via at least one second helical spring, and that a spring longitudinal axis of the at least one second helical spring is not situated in a plane essentially orthogonal to the roller axis of rotation, wherein the spring longitudinal axis of at least one, preferably all second helical springs extends essentially in the direction of the roller axis of rotation.

In an alternative embodiment, in which the helical springs extending essentially in the direction of the roller axis of rotation and centering the compactor roller axially with respect to the machine chassis may be omitted, it is proposed that at least one part, preferably all, of the first helical springs are not arranged with spring longitudinal axes situated in at least one plane essentially orthogonal to the roller axis of rotation.

In order to support the radial centering in a defined way in this construction, it may be provided that in at least one pair of first coupling areas, the first helical springs are respectively supported on the machine chassis in a support area, and that the support areas have a different radial distance to the roller axis of rotation than the first coupling areas that are coupled to the machine chassis by these first helical springs.

A device for generating an essentially periodic acceleration, preferably an oscillating acceleration and/or a vibrational acceleration, may be provided in the compactor roller.

Figure 2:
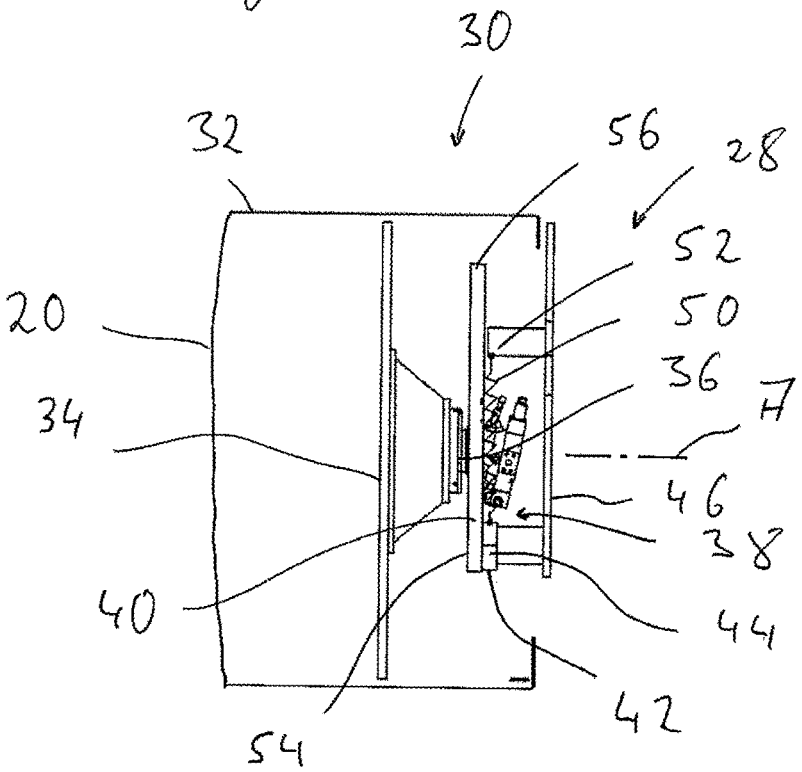
Figure 3:
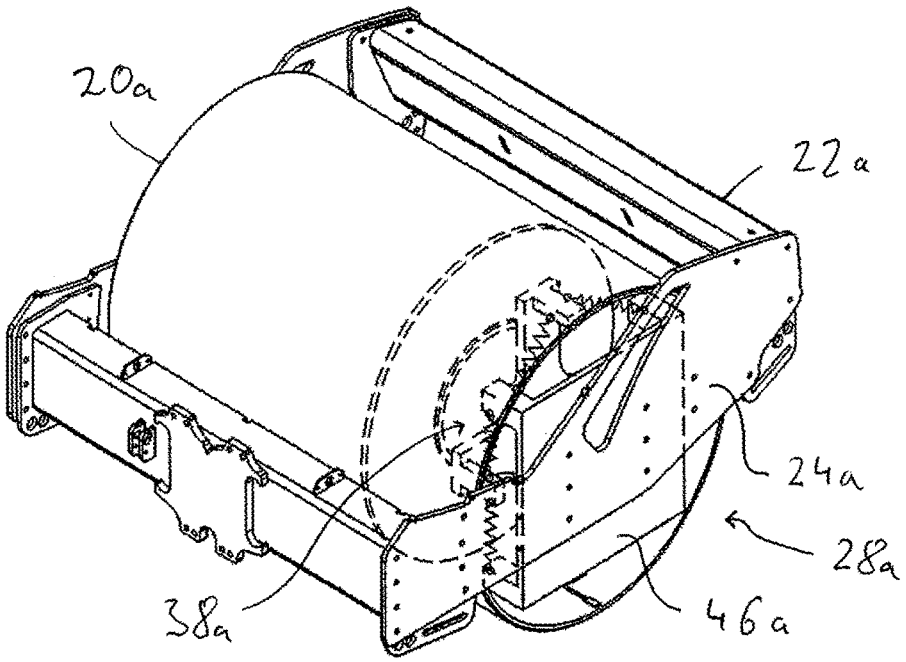
Figure 4:
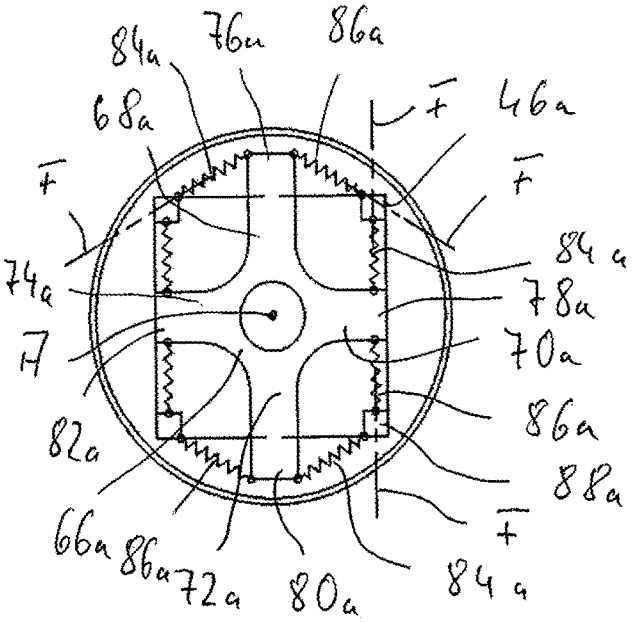
Figure 5:
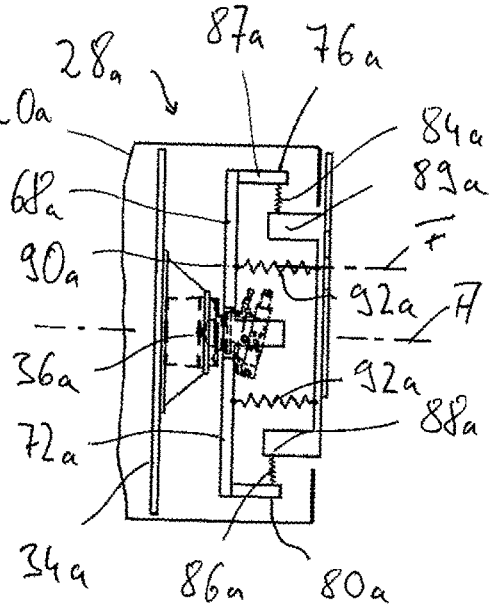
Figure 6:
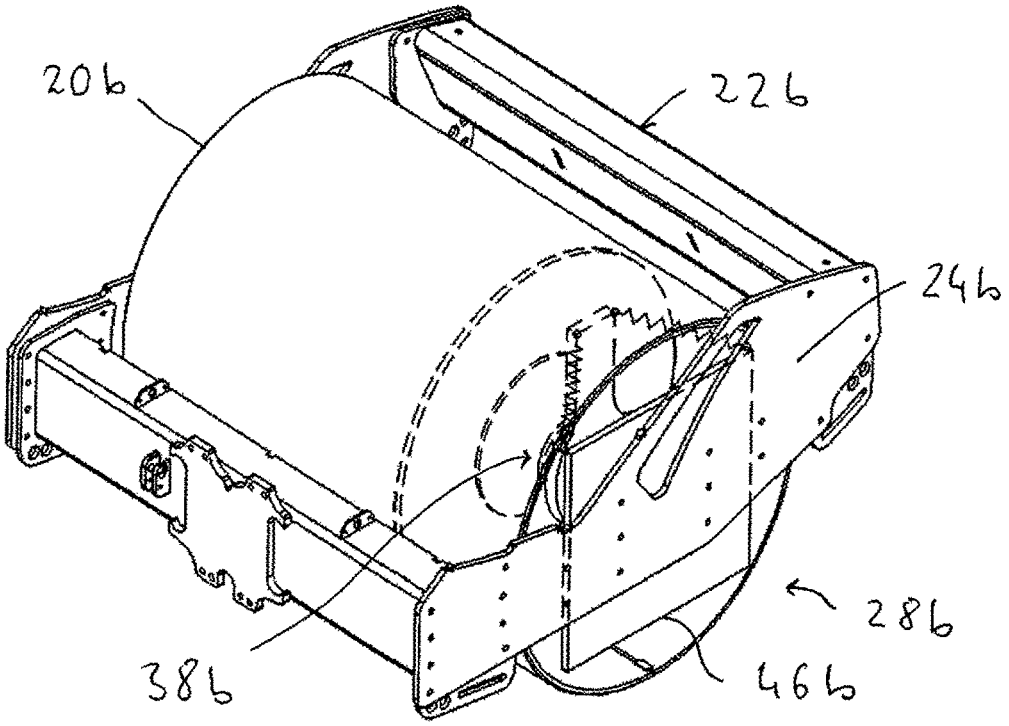
Figure 7:
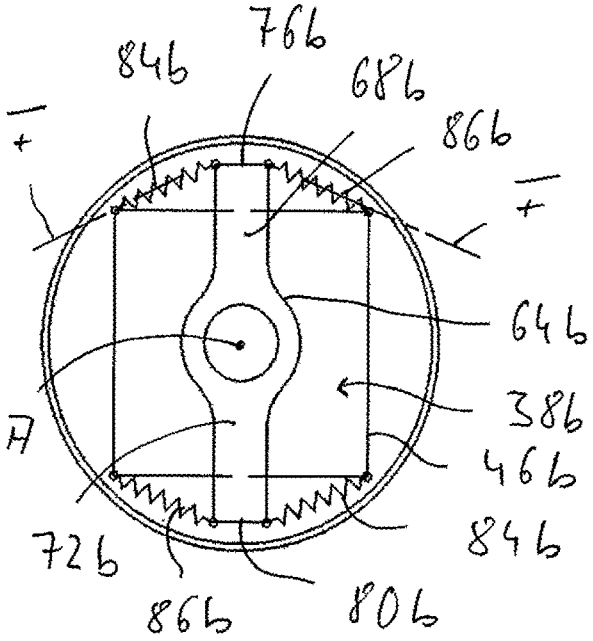
Figure 8:
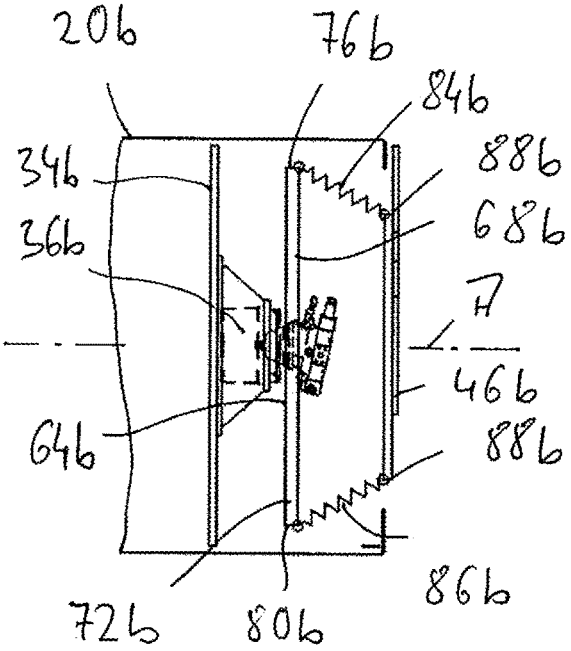
Figure 5:
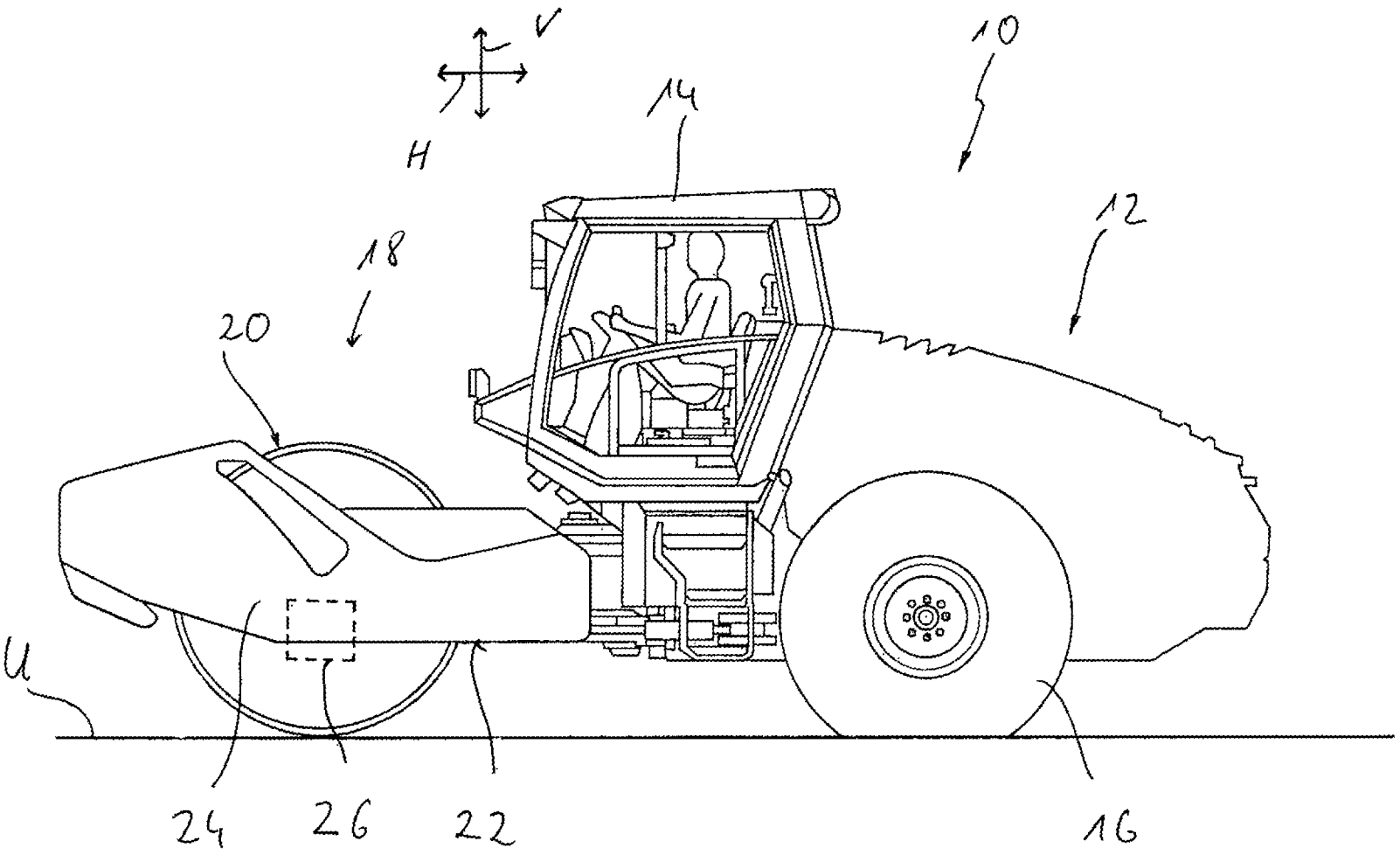

The present invention is subsequently described in detail with respect to the enclosed figures. As shown in:

FIG. 1 a compactor roller supported on a machine chassis;

FIG. 2 the compactor roller from FIG. 1 with a suspension assembly in a radial view;

FIG. 3 a compactor roller supported on a machine chassis with an alternative embodiment of a suspension assembly for the compactor roller;

FIG. 4 the compactor roller from FIG. 3 with an assigned suspension assembly in an axial view;

FIG. 5 the compactor roller from FIG. 3 with an assigned suspension assembly in a radial view;

FIG. 6 a compactor roller rotatably supported on a machine chassis with another alternative embodiment of a suspension assembly;

FIG. 7 the compactor roller from FIG. 6 with an assigned suspension assembly in an axial view;

FIG. 8 the compactor roller from FIG. 6 with an assigned suspension assembly in a radial view;

FIG. 9 a soil compactor with a compactor roller supported on a machine chassis in a side view.

In FIG. 9, a soil compactor, generally designated with 10, is shown, which has a driver's cabin 14 on a rear end 12, and wheels 16 drivable by an engine unit (not shown) which may likewise be provided on rear end 12, for forward movement of soil compactor 10. To steer soil compactor 10, a front end 18, connected to rear end 12 to be pivotable about an essentially vertical axis, comprises a machine chassis 22, surrounding a compactor roller 20, with longitudinal chassis sections 24 extending essentially in a movement direction of soil compactor 10 and accommodating compactor roller 20 therebetween. Compactor roller 20 is supported or suspended on these longitudinal chassis sections 24 in its two axial end areas, axial relates here to a roller axis of rotation, about which compactor roller 20 is rotatably supported on machine chassis 22, via a suspension assembly, which is subsequently described in detail, in such a way that compactor roller 20 may execute a relative movement with respect to machine chassis 22. A relative mobility of this type enables a vibrational decoupling between compactor roller 20 and machine chassis 22, which then has substantial importance when a device 26, indicated only schematically in FIG. 9, is provided on or in compactor roller 20 with which a force or an acceleration may be exerted on compactor roller 20 to accelerate the same, for example, in the vertical direction V or in the circumferential direction about the roller axis of rotation. These types of devices, used to generate a vibrational acceleration or vibrational movement and/or an oscillating acceleration or oscillating movement of compactor roller 20, are long known in the prior art and do not need to be described in detail.

Different embodiments of suspension assemblies will subsequently be described with reference to FIGS. 2 through 8, with which suspension assemblies compactor roller 20 is supported or suspended on machine chassis 22, and which provide a vibration decoupling between compactor roller 20 and machine chassis 22 due to the relative mobility between compactor roller 20 and machine chassis 22, so that vibrations generated in the area of compactor roller 20 are essentially not transferred to machine chassis 22 and thus to front end 18 or also to rear end 22. Reference is made to the fact that compactor roller 20 is preferably supported or suspended in its two axial end areas via suspension assemblies on machine chassis 20 configured essentially identical to one another. However, suspension assemblies configured differently from one another might basically also be used on the two axial end areas of compactor roller 20. The configuration of these types of suspension assemblies is subsequently described with reference to a suspension assembly provided on one of the two end areas of a compactor roller 20.

A first embodiment of a suspension assembly, generally designated with 28, for compactor roller 20 is depicted in FIGS. 1 and 2. Using axial end area 30 of compactor roller 20, depicted in FIG. 2, it is clear that said roller has a roller shell 32 cylindrical to roller axis of rotation A and surrounded by a circular contour. A roller disk 34, generally also designated as a round blank, may be provided in roller shell 32 in axial end area 30. A drive motor 36 may be supported on said roller disk 34, by means of which compactor roller 20 is drivable for rotating about roller axis of rotation A. This construction may be provided in particular if, unlike in FIG. 9, soil compactor 10 likewise has a compactor roller on the rear end, and at least one of the compactor rollers is driven for rotation. If soil compactor 10 has drive wheels 16, depicted in FIG. 9, it is not necessary for compactor roller 20 to have its own drive motor. At the same time, the drive motor for the previously described device 26 may be provided on or in compactor roller 20 to drive unbalanced masses of the same to rotate about respective axes of rotation.

Suspension assembly 28 comprises a roller carrier assembly, generally designated with 38, on which compactor roller 20 is supported to be rotatable about roller axis of rotation A, for example, via drive motor 36 or a bearing element provided on roller disk 34. Roller carrier assembly 38 comprises a first carrier element 40, on which compactor roller 20 is rotatably drivable about roller axis of rotation A.

Roller carrier assembly 38 additionally comprises a second carrier element 42, which is supported in a first coupling area 44 on machine chassis 22 to be pivotable about an axis essentially parallel to roller axis of rotation A. For this purpose, a support plate 46, on which second carrier element 42 is pivotably supported, may be provided or supported on machine chassis 22.

Second carrier element 42 is coupled via a helical spring 50 to machine chassis 22, for example, to support plate 46, in a second coupling area 48. In addition, a support area 52, on which one of the two end areas of helical spring 50 engages, may be provided on machine chassis 22 or support plate 46, while the other of the two end areas of helical spring 50 engages at second coupling area 48 of second carrier element 42. It is clear in the depiction of FIGS. 1 and 2 that second carrier element 42 extends in an approximately horizontal direction H, whereas helical spring 50 extends in an approximately vertical direction.

First carrier element 40 is pivotably connected to second carrier element 42 in a third coupling area 54. Third coupling area 54 thereby is situated in a longitudinal extension direction of second carrier element 42 between first coupling area 44 and second coupling area 48, which are respectively provided on end areas of second carrier element 42.

In a fourth coupling area 56, arranged essentially diametrically opposite third coupling area 44 with respect to roller axis of rotation A, a helical spring 58 engages with its first end area on first carrier element 40. The other end area of helical spring 48 engages on a support area 60, provided for example equally on support plate 46 or on machine chassis 42, so that first carrier element 40, and thus compactor roller 20, are supported on machine chassis 22 via helical spring 58.

It is clear in FIG. 1, that first carrier element 40 extends approximately in vertical direction V so that fourth coupling area 56 and also the roller axis of rotation are positioned in vertical direction V over third coupling area 54. This means that, also due to the effect of gravity, no substantial tilting torque providing a pivot of first carrier element 40 with respect to second carrier element 42 occurs. Instead, due to the circumstance that machine chassis 22 hangs on compactor roller 20 via the two carrier elements 40, 42 coupled to one another, roller carrier assembly 38 enters a state in which the two carrier elements 40, 42 are in a state of relative pivot position corresponding to a minimum potential energy with respect to one another.

Due to the articulated configuration of roller carrier assembly 38, compactor roller 20 may carry out a relative movement with respect to machine chassis 22 essentially in vertical direction V by compressing or extending helical spring 50, whereas compactor roller 20 may carry out a movement essentially in horizontal direction H with respect to machine chassis 22 by compressing or extending helical spring 58. Reference is made in this context to the fact that a direction may be understood as horizontal direction H, which is essentially parallel to a substrate U to be compacted, whereas a direction may be understood as vertical direction V, which is essentially orthogonal to substrate U to be compacted.

Due to suspension assembly 38, a relative movement of compactor roller 20 in every possible direction essentially orthogonal to roller axis of rotation A is enabled by compression or extension of the two helical springs 50, 58, whereas compactor roller 20 is supported in a defined way in the direction of roller axis of rotation A via roller carrier assembly 38 with respect to machine chassis 22. This guarantees that transverse forces, thus forces acting in the direction of roller axis of rotation A may be transferred between compactor roller 20 and machine chassis 22, which may occur, in particular during steering soil compactor 10.

An alternative embodiment of a suspension assembly is shown in FIGS. 3 through 5. In FIGS. 3 through 5, components or assemblies, which correspond to previously described components or assemblies with respect to structure or function, are designated with the same reference numeral with the addition of an appended "a".

Suspension assembly 28*a* comprises a roller carrier assembly 38, which has a carrier element 64*a* configured essentially in a cross shape, supporting compactor roller 20*a* to be rotatable about roller axis of rotation A. Starting from a central body section 66*a*, which rotatably mounts compactor roller 20, four coupling arms 68*a*, 70*a*, 72*a*, 74*a* extend at a mutual angular distance of approximately 90° from one another, such that coupling arms 68*a* and 72*a* are arranged diametrically opposite one another with respect to roller axis of rotation A. Correspondingly, coupling arms 70*a*, 74*a* are arranged diametrically opposite one another with respect to roller axis of rotation A. A first coupling area 76*a*, 78*a*, 80*a*, 82*a* is respectively formed in each of the end areas of coupling arms 68*a*, 70*a*, 72*a*, 74*a* spaced apart from roller axis of rotation A. In each of first coupling areas 76*a*, 78*a*, 80*a*, 82*a*, carrier element 64*a* is coupled to machine chassis 22*a* or to support plate 46*a* provided thereon by means of two helical springs 84*a*, 86*a*. It is thereby clear based on FIGS. 4 and 5, that the two helical springs 84*a*, 86*a*, via which first coupling area 76*a*, positioned highest in the vertical direction, is coupled to machine chassis 22*a*, are arranged with spring longitudinal axes F angled with respect to one another, which also equally applies for helical springs 84*a*, 86*a* which couple first coupling area 80*a*, positioned lowest in the vertical direction, on machine chassis 22*a*.

In the case of the two first coupling areas 78*a*, 82*a*, arranged centered in vertical direction V, thus essentially at the same height as roller axis of rotation A, helical springs 84*a*, 86*a*, which couple these coupling areas respectively to machine chassis 22*a*, are arranged with spring longitudinal axes F essentially parallel to one another and thus are also arranged essentially continuously. The positioning of helical springs 84*a*, 86*a*, which interact in particular with first coupling areas 76*a*, 80*a*, as inclined with respect to horizontal direction H, enables a transfer of a drive torque with a large leverage between compactor roller 20*a*, and machine chassis 22*a*. Forces acting in vertical direction V may be efficiently transferred via helical springs 84*a*, 86*a*, oriented essentially in vertical direction V, via which first coupling areas 70*a* or 74*a* are supported with respect to machine chassis 22*a*.

It is clear from FIGS. 3 through 5, that all helical springs 84*a*, 86*a*, which couple first coupling areas 76*a*, 78*a*, 80*a*, 82*a* on machine chassis 22*a* or support plate 46*a*, and which are to be interpreted in the meaning of the present invention as first helical springs, are arranged with their spring longitudinal axes F in a common plane orthogonal to roller axis of rotation A, which may correspond, for example, to the drawing plane in FIG. 4. The end areas of said first helical springs 84*a*, 86*a*, with which the same are connected to first coupling areas 76*a*, 78*a*, 80*a*, 82*a*, and the end areas of said first helical springs 84*a*, 86*a*, with which the same are connected to respective support areas 88*a* of the machine chassis or support plate 46*a*, thus have essentially no offset to one another in the direction of roller axis of rotation A.

Said first helical springs 84*a*, 86*a* are thus essentially provided and suited for supporting compactor roller 20*a* perpendicularly to roller axis of rotation A with respect to machine chassis 22*a* during turns. To provide axial centering, second coupling areas 90*a* are provided on carrier element 64*a*, for example on central body area 66*a* of the same, in which coupling areas carrier element 64*a* is coupled to machine frame 22*a*, for example to support plate 46*a*, via second helical spring 92*a*, and is thus supported in the axial direction. Second helical springs 92*a* are thereby preferably arranged in such a way that their spring longitudinal axes F extend essentially parallel to roller axis of rotation A. For example, four second helical springs 92*a* of this type may be provided with identical circumferential spacing to one another. To be able to achieve this arrangement of first helical springs 84*a*, 86*a* situated in one plane, sections 87*a* or 89*a* may be provided, for example, on carrier element 64*a* or on first coupling areas 76*a*, 78*a*, 80*a*, 82*a* and on machine chassis 22*a* or on support plate 46*a*, which in each case overlap one another in the direction of roller axis of rotation A.

In the embodiment depicted in FIGS. 3 through 5, compactor roller 20*a* is also supported with respect to machine chassis 22*a* by first helical springs 84*a*, 86*a* for a movement essentially perpendicular to roller axis of rotation A, and are thus movable in vertical direction V and also in horizontal direction H with respect to machine chassis 22*a*. The defined axial positioning and also in particular the transmission of axially acting forces, thus for example turning forces, are carried out essentially via second helical springs 92*a*. In an alternative embodiment, one or more coupling rods extending essentially in the direction of roller axis of rotation A may be provided instead of the second helical springs, said coupling rods are supported on support plate 46*a* on one side and on carrier element 64*a* on the other side, wherein coupling rods of this type are supported elastically in at least one of their end areas, for example via a rubber bearing, to allow a movement of compactor roller 20*a* in the direction of roller axis of rotation A.

A modification of the embodiment depicted in FIGS. 3 through 5 is depicted in FIGS. 6 through 8. In these figures, components, which correspond to previously described components with respect to structure or function, are designated with the same reference numeral with the addition of an appended "b".

In the embodiment depicted in FIGS. 6 through 8, carrier element 64*b* of roller carrier assembly 38*b* of a respective suspension assembly 28*b* only has the two coupling arms 68*b* and 72*b*, which extend essentially in the vertical direction, with first coupling areas 76*b*, 80*b* provided thereon. Each of these two first coupling areas 76*b*, 80*b* is again coupled to machine chassis 22*b* or to a support plate 46*b* provided thereon via two helical springs 84*b*, 86*b*. In contrast to the embodiment shown in FIGS. 3 through 5, first helical springs 84*b*, 86*b* are not situated with their respective spring longitudinal axes F in a plane essentially orthogonal to roller axis of rotation A. In this case, first coupling areas 76*b*, 80*b* and support areas 88*a*, in which helical springs 84*b*, 86*b* engage on support plate 46*b* or on machine chassis 22*b*, are not only offset with respect to one another in the circumferential direction about roller axis of rotation, but are also offset in the direction of roller axis of rotation A.

In this embodiment, compactor roller 20*b* is supported on machine chassis 22*b* via first helical springs 84*b*, 86*b* to be movable not only in a direction perpendicular to roller axis of rotation A, but is also supported and held centered with respect to the machine chassis in the direction of roller axis of rotation A, in particular if suspension assemblies 28*b*, which are structured essentially identically to one another on the two axial end areas of compactor roller 22*b*, are used for the suspension of compactor roller 20*b* on machine chassis 22*b*. Thus, in this embodiment, the second helical springs, as used in the embodiment in FIGS. 3 through 5 and extending essentially in the direction of roller axis of rotation A, may be omitted. This simplifies the structure of a respective suspension assembly 28*b* substantially, as in each suspension assembly 28*b* a total of only four first helical springs 84*b*, 86*b* and no second helical springs are used. It is additionally particularly advantageous that the two first coupling areas 76*b*, 80*b* are arranged in vertical direction V over or below roller axis of rotation A, thus the two coupling arms 68*b*, 72*b* extend essentially in vertical direction V. Forces acting in particular in the vertical direction may be efficiently transferred via helical springs 84*b*, 86*b* interacting with these two first coupling areas 76*b*, 80*b*, wherein it is assumed that, due to the weight of soil compactor 10, these forces acting and supporting in the vertical direction are significantly larger than the forces acting in horizontal direction H during compacting operation. At the same time, this embodiment of a suspension assembly 28*b* also ensures that an efficient vibrational decoupling is achieved via first helical springs 84*b*, 86*b*, which couple compactor roller 20*b* to machine chassis 22*b*, so that periodic movements or accelerations occurring in the area of compactor roller 22*b* are essentially not transferred to machine chassis 22*b*.

All embodiments of a suspension assembly according to the invention for a compactor roller exploit the advantage that, due to the use of helical springs as the elastic elements transferring the suspension forces, an excellent vibrational decoupling is indeed achieved between the compactor roller and the machine chassis rotatably supporting the same; however, a substantial damping effect due to absorption of energy in the elastically deformable elements does not occur. The energy provided in the area of the compactor roller, with which the compactor roller is to be set into a periodic movement, thus for example, a vibrational movement or vibrational acceleration directed essentially in vertical direction V, or an oscillation movement or oscillation acceleration directed essentially in the circumferential direction, may be completely used to generate this movement.

Reference is finally made to the fact that the most different variations may naturally be provided with respect to the configuration or the arrangement of the helical springs, which may be loaded both with pressure and also tension. Thus, for example, in the embodiment depicted in FIGS. 3 through 5, the first helical springs, or at least one part of them, may also be arranged such that their spring longitudinal axes are not exactly situated in a plane essentially orthogonal to the roller axis of rotation. In this way, these first helical springs may also contribute to an axial centering of the compactor roller.

The invention claimed is:

1. A soil compactor, comprising at least one compactor roller supported on a machine chassis to be rotatable about a roller axis of rotation, wherein at least one compactor roller is supported in its two axial end areas respectively via a suspension assembly on the machine chassis to be movable with respect to the machine chassis, wherein at least one suspension assembly comprises at least one helical spring which couples the compactor roller movably to the machine chassis, wherein the at least one suspension assembly comprises a roller carrier assembly, wherein the compactor roller is supported on the roller carrier assembly to be rotatable about the roller axis of rotation, and that the roller carrier assembly is coupled to the machine chassis via the at least one helical spring, and wherein the roller carrier assembly comprises a first carrier element, which supports the compactor roller to be rotatable about the roller axis of rotation, and a second carrier element, pivotably supported in a first coupling area on the machine chassis and coupled to the machine chassis in a second coupling area via the at least one helical spring, wherein the first carrier element is pivotably coupled to the second carrier element in a third coupling area.

2. The soil compactor according to claim 1, wherein the third coupling area is positioned between the first coupling area and the second coupling area in a longitudinal extension direction of the second carrier element, and/or that the third coupling area is positioned approximately below the roller axis of rotation in the vertical direction.

3. The soil compactor according to claim 2, wherein the at least one helical spring, which couples the second carrier element to the machine chassis, is supported, using the machine chassis, in a support area on the machine chassis that is situated approximately above or below the second coupling area in the vertical direction.

4. The soil compactor according to claim 1, wherein the first carrier element is coupled in a fourth coupling area to the machine chassis via the at least one helical spring.

5. The soil compactor according to claim 4, wherein the fourth coupling area is positioned in the vertical direction approximately over or below the third coupling area and/or the roller axis of rotation.

6. The soil compactor according to claim 4, wherein the at least one helical spring, which couples the first carrier element to the machine chassis, is supported on the machine chassis in a support area on the machine chassis situated in the vertical direction at approximately the same height as the fourth coupling area.

7. The soil compactor according to claim 1, wherein a device for generating a periodic acceleration, an oscillating acceleration and/or a vibrational acceleration is provided in the compactor roller.

8. The soil compactor according to claim 1, wherein the at least one helical spring, which couples the second carrier element to the machine chassis, is supported, using the machine chassis, in a support area on the machine chassis situated offset from the first coupling area in both a circumferential direction about the roller axis of rotation and a direction of the roller axis of rotation.

9. A soil compactor, comprising at least one compactor roller supported on a machine chassis to be rotatable about a roller axis of rotation, wherein at least one compactor roller is supported in its two axial end areas respectively via a suspension assembly on the machine chassis to be movable with respect to the machine chassis, wherein at least one suspension assembly comprises at least one helical spring which couples the compactor roller movably to the machine chassis, wherein the at least one suspension assembly comprises a roller carrier assembly, wherein the compactor roller is supported on the roller carrier assembly to be rotatable about the roller axis of rotation, and that the roller carrier assembly is coupled to the machine chassis via the at least one helical spring, wherein the roller carrier assembly comprises a carrier element which supports the compactor roller to be rotatable about the roller axis of rotation, and that the carrier element is coupled to the machine chassis in a plurality of first coupling areas arranged at a circumferential spacing from one another about the roller axis of rotation via the at least one helical spring respectively, wherein a plurality of first coupling areas following one another in the circumferential direction about the roller axis of rotation is provided on the carrier element and that in each coupling area, the carrier element is coupled to the machine chassis via at least two first helical springs of the at least one helical spring, wherein at least one pair of first coupling areas, situated diametrically opposite one another with respect to the roller axis of rotation, is provided on the carrier element, wherein, in the case of at least one pair of first coupling areas, two first helical springs of the at least one helical spring extend at each of the two first coupling areas starting from one respective first coupling area, approximately parallel to one another and in opposite directions, and/or that the case of at least one pair of first coupling areas, two first helical springs of the at least one helical spring extend at each of the two first coupling areas, starting from one respective first coupling area, angled with respect to one another and in opposite directions, wherein one pair of first coupling areas on a carrier element is provided with the first helical springs extending approximately parallel to one another, and one pair of first coupling areas is provided with the first helical springs angled with respect to one another, wherein the first coupling area of the one pair of first coupling areas and the first coupling area of the other pair of first coupling areas are arranged alternating in the circumferential direction, and/or wherein the first coupling areas with first helical springs angled with respect to one another are arranged approximately above one another in the vertical direction and the first coupling areas with the first helical springs extending approximately parallel to one another are situated at approximately the same height in the vertical direction.

10. The soil compactor according to claim 9, wherein at least one of the first helical springs are arranged with spring longitudinal axes situated in at least one plane essentially orthogonal to the roller axis of rotation.

11. The soil compactor according to claim 10, wherein the carrier element is coupled in at least one second coupling area to the machine chassis via at least one second helical spring of the at least one helical spring, and that a spring longitudinal axis of the at least one second helical spring is not situated in a plane essentially orthogonal to the roller axis of rotation, wherein the spring longitudinal axis of at least one of the second helical springs extends essentially in the direction of the roller axis of rotation.

12. A soil compactor, comprising at least one compactor roller supported on a machine chassis to be rotatable about a roller axis of rotation, wherein at least one compactor roller is supported in its two axial end areas respectively via a suspension assembly on the machine chassis to be movable with respect to the machine chassis, wherein at least one suspension assembly comprises at least one helical spring which couples the compactor roller movably to the machine chassis, wherein the at least one suspension assembly comprises a roller carrier assembly, wherein the compactor roller is supported on the roller carrier assembly to be rotatable about the roller axis of rotation, and that the roller carrier assembly is coupled to the machine chassis via the at least one helical spring, wherein the roller carrier assembly comprises a carrier element which supports the compactor roller to be rotatable about the roller axis of rotation, and that the carrier element is coupled to the machine chassis in a plurality of first coupling areas arranged at a circumferential spacing from one another about the roller axis of rotation via the at least one helical spring respectively, and wherein a plurality of first coupling areas following one another in the circumferential direction about the roller axis of rotation is provided on the carrier element and in each coupling area, the carrier element is coupled to the machine chassis via at least two first helical springs of the at least one helical spring, wherein at least one of the first helical springs are arranged with spring longitudinal axes not situated in at least one plane orthogonal to the roller axis of rotation.

13. The soil compactor according to claim 12, wherein in at least one pair of first coupling areas the first helical springs are supported respectively on the machine chassis in a support area, and that the support areas have a different radial spacing to the roller axis of rotation than the first coupling area that are coupled to the machine chassis by these first helical springs.

* * * * *